United States Patent [19]

Mokuya et al.

[11] 4,449,496

[45] May 22, 1984

[54] CYLINDER-NUMBER-CONTROLLED ENGINE

[75] Inventors: Hiroichi Mokuya; Masao Yokko, both of Shizuoka; Hiroyuki Komatsu, Hamamatsu; Katsuhisa Suzuki, Hamana; Takeo Kitayama, Shizuoka, all of Japan

[73] Assignee: Suzuki Motor Company Limited, Japan

[21] Appl. No.: 297,178

[22] Filed: Aug. 28, 1981

[30] Foreign Application Priority Data

| | | | |
|---|---|---|---|
| Sep. 10, 1980 | [JP] | Japan | 55-125546 |
| Dec. 2, 1980 | [JP] | Japan | 55-169763 |
| Dec. 4, 1980 | [JP] | Japan | 55-171395 |
| May 29, 1981 | [JP] | Japan | 56-82034 |

[51] Int. Cl.[3] ..... F02D 17/02

[52] U.S. Cl. ..... 123/198 F; 123/580; 261/23 A

[58] Field of Search ..... 123/198 F, 580; 261/23 A

[56] References Cited

U.S. PATENT DOCUMENTS

| | | | |
|---|---|---|---|
| 4,106,471 | 8/1978 | Nakajima et al. | 123/198 F |
| 4,274,382 | 6/1981 | Sugasawa et al. | 123/198 F |
| 4,296,719 | 10/1981 | Takahashi et al. | 123/198 F |
| 4,337,740 | 7/1982 | Sugasawa et al. | 123/198 F |
| 4,345,432 | 8/1982 | Lida et al. | 123/198 F |
| 4,365,597 | 12/1982 | Lizuka et al. | 123/198 F |
| 4,365,598 | 12/1982 | Sugasawa | 123/198 F |

*Primary Examiner*—Ira S. Lazarus

*Attorney, Agent, or Firm*—McGlew and Tuttle

[57] ABSTRACT

A multicylinder engine whose working cylinders are variably controlled in number to suit operating requirements, with an air fuel mixture fed from a single throttle valve to the working cylinder or cylinders through an intake manifold, includes at least one normally closed control valve installed in at least one intake pipe of the intake manifold. When the throttle valve has opened to a prescribed degree, the control valve instantly opens fully or almost fully or to a prescribed degree, independently of the throttle valve.

9 Claims, 16 Drawing Figures

CYLINDER-NUMBER-CONTROLLED ENGINE

FIELD AND BACKGROUND OF THE INVENTION

This invention relates to a cylinder-number-controlled engine, and more specifically to a multicylinder engine whose working cylinders are variably controlled in number to suit operating requirements, with an air fuel mixture fed from a single throttle valve to the working cylinder or cylinders through an intake manifold, including at least one normally closed control valve installed in at least one intake pipe of the intake manifold, the control valve being adapted to open momentarily, independently of the throttle valve.

It is not uncommon these days that multicylinder engines are designed so that the number of working cylinders is increased or decreased according to the changing operating conditions of the engine. With a three-cylinder engine, for example, only one cylinder operates when the engine is idling or running under low-load condition. As the engine load increases, say at the vehicular velocity of about 40 kilometers an hour, one more cylinder joins. Under heavier loads all three cylinders take part in giving the necessary power output. In this manner the number of cylinders at work is controlled at all times to attain an optimum air fuel ratio and reduce fuel consumption. To realize this technical ideal with multicylinder engines, usually one or more or all of the intake manifold pipes are equipped with a control valve each which is opened correspondingly to the opening of the throttle valve.

The existing arrangements, which thus invariably use control valves the opening of which corresponds to that of the throttle valve, have a common disadvantage in that, especially in the early stage of each control valve opening, the engine operates in an irregular combustion zone $\alpha$, as hatched in FIG. 1, gives a shock to the vehicle and mars riding comfort.

SUMMARY OF THE INVENTION

It is a primary object of the invention to provide a cylinder-number-controlled engine and an intake system for such a multicylinder engine which will not detract from the riding pleasure of the vehicle in the manner described above.

Another object of the invention is to provide a cylinder-number-controlled engine in which an air fuel mixture is fed from a single throttle valve to the working cylinder or cylinders through an intake manifold, comprising at least one normally closed control valve installed in at least one intake pipe of the intake manifold, the control valve being adapted to open momentarily, independently of the throttle valve.

Another object of the invention is to provide an intake system for a multicylinder engine in which at least one control valve opens instantly to a prescribed degree when the throttle valve has attained a prescribed opening, independently of the throttle valve, and then continues to open together with the throttle valve since it is operatively connected to the throttle valve.

Still another object of the invention is to provide an intake system for a multicylinder engine in which at least one control valve is opened when the engine is cold, even if the throttle valve is not open to a prescribed degree.

Yet another object of the invention is to provide an intake system for a multicylinder engine in which, when the throttle valve is totally closed, a low-speed fuel system is cut off in response to the throttle valve motion.

A further object of the invention is to provide an intake system for a multicylinder engine in which, in order that the riding comfort of the vehicle with the cold engine may be improved by taking the advantage of the multicylinder arrangements, one or more or all of control valves are opened irrespective of the vehicular velocity.

An additional object of the invention is to provide a cylinder-number-controlled engine in which, when the clutch is disengaged, at least one control valve is momentarily opened, in response to a signal generated by declutching, to improve the startability of the engine.

The above and other objects and advantages of the invention will become more apparent from the following description with reference to the accompanying drawings showing preferred embodiments thereof.

BRIEF DESCRIPTION OF THE DRAWINGS

In the drawings:

FIG. 1(I) is a graph showing the relation between control valve opening and throttle valve opening representing the characteristics of an ordinary multicylinder engine equipped with control valves;

DESCRIPTION OF THE PREFERRED EMBODIMENTS

Figure 1:
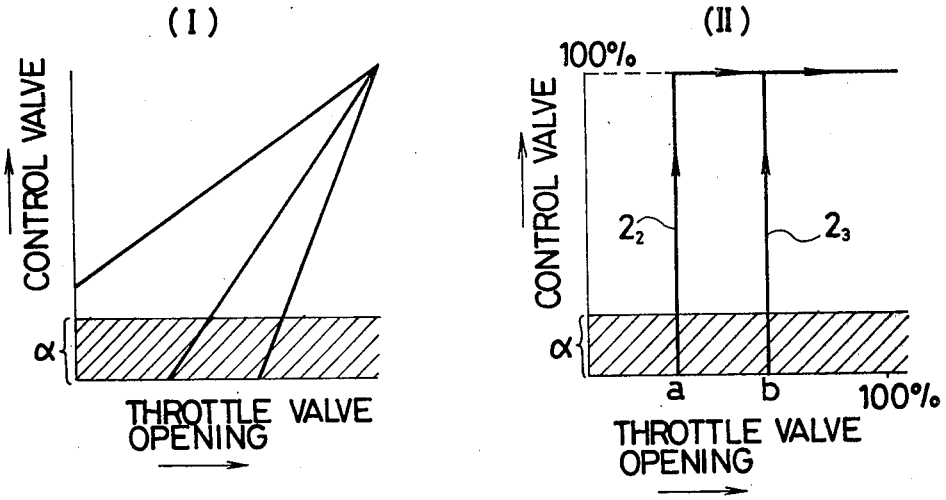
FIG. 1(II) is a graph showing the relation between control valve opening and throttle valve opening representing the characteristics of a multicylinder engine according to the invention.
Figure 2:
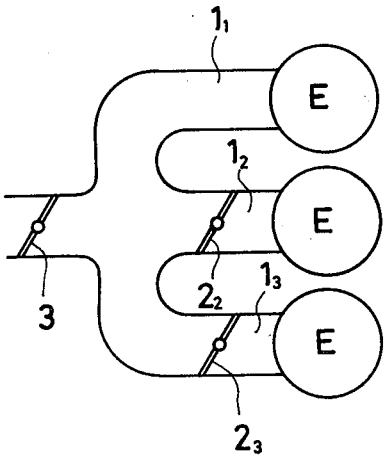
FIG. 2 is a schematic view of the first embodiment of the invention indicating the locations of control valves.
Figure 3:
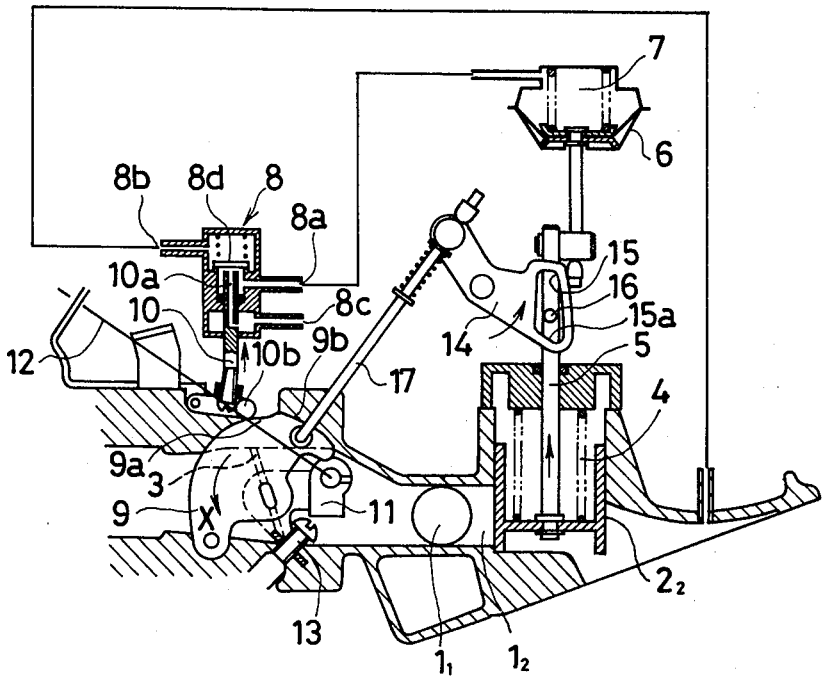
FIG. 3 is a vertical sectional view of arrangements for operating each control valve of the first embodiment.

First embodiment (Refer to FIGS. 1 to 3.)

The first embodiment of the invention is one in which, when the throttle valve has opened to a prescribed degree, each of the above-mentioned control valves, in succession, opens fully or almost fully in an instant, independently of the throttle valve.

In the embodiment shown, some of intake manifold pipes $1_1$–$1_n$, namely, $1_2$–$1_n$, have normally closed control valves $2_2$–$2_n$ installed therein, one for each. Those valves instantly open fully or almost fully, in succession, each time the throttle valve 3 turns to a prescribed opening, independently of the throttle valve. FIG. 2 illustrates a three-cylinder engine incorporating this technical idea. Here, the intake pipes $1_2$, $1_3$ communicating with engine cylinders E are shown with built-in control valves $2_2$, $2_3$, respectively. FIG. 3 shows arrangements for operating the control valve $2_2$ installed in the intake pipe $1_2$.

The control valve $2_2$ is normally biased into a closure position by a spring 4 and is mechanically linked with a vacuum actuator 6 by a rod 5 and the like. The vacuum actuator 6 has a pressure chamber 7 communicating with the outlet port 8*a* of a directional control valve 8. The inlet port 8*b* of the valve 8 is communicating with a portion of the intake pipe $1_2$ downstream from the control valve $2_2$. Aside from the outlet port 8*a* and the inlet port 8*b*, the directional control valve has an atmospheric air port 8*c*. Normally the inlet port 8*b* remains closed while the outlet port 8*a* is in communication with the air port 8*c*. When the throttle valve 3 has turned to a prescribed opening, the directional control valve is operated by a switching mechanism to be described below, so that its inlet and outlet ports 8*b*, 8*a* are communicated and the air port 8*c* is closed. The switching mechanism compises a cam 9 adapted to turn together with the throttle valve 3, and a rod 10 in contact at one end with the cam to move at the other end the valve body 8*d* of the valve 8.

In FIG. 3, the rod 10 is shown to be hollow with an axial passage 10*a* and having a roller 10*b* provided at the lower end, and the cam 9 is shown having a groove 9*a* and a land 9*b*. Also shown are a throttle lever 11, a throttle cable 12, and a stopper 13 for adjusting the opening of the throttle valve 3 for idling.

A lever 14, disposed at a suitable point of the housing, has a slot 15 formed at one end in slidable register with a protuberance or pin 16 on the rod 5 of the actuator 6. The other end of the lever 14 is linked with the cam 9 by a rod 17.

The operation of the embodiment will now be described. As the accelerator pedal (not shown) is depressed, the throttle valve 3 in the position shown in FIG. 3 is turned counterclockwise and is increasingly opened by the aid of the throttle cable 12 and throttle lever 11. Correspondingly, the cam 9 too turns counterclockwise (as indicated by the arrow X). When the cam 9 has turned through a predetermined angle, it causes the roller 10*b* to ride on its land 9*b*, thus pushing the rod 10 upward. The upper end of the raised rod 10 comes into contact with the valve body 8*d* to close the passage 10*a*, and thence lifts the valve body 8*d* to establish communication between the inlet and outlet ports 8*b*, 8*a*. This permits the pressure chamber 7 of the actuator 6 communicate with a portion of the intake pipe $1_2$ downstream of the control valve $2_2$ and supplied with the negative pressure or vacuum to operate the actuator 6. The actuator, in turn, pulls the control valve $2_2$ upward by means of the rod 5, opening the valve fully or almost fully.

From then on, while the throttle valve 3 is open at or more than the prescribed degree of opening, the control valve $2_2$ is held wide open or almost fully open.

As the cam 9 continues to rotate, the lever 14 is pivotally turned counterclockwise by the rod 17, bringing the lower edge 15*a* of the slot 15 upward. This prevents closing of the control valve $2_2$ due to decreased operating power of the vacuum actuator 6 which results from a decrease in vacuum inside the intake pipe $1_2$ downstream of the control valve with the approach of the throttle valve 3 to the fully open position. In that case, the pin 16 on the rod 5 engages the lower edge 15*a* of the slot 15 to limit the descent of the control valve $2_2$.

While the actuating mechanism for the control valve $2_2$ has so far been explained, the same applies to the other control valve $2_3$, and therefore the explanation of the latter is omitted. The only difference is that the latter uses a cam whose land is staggered a certain distance counterclockwise from the land 9*b* of the cam 9 for the former, so that the latter may be timed to open with a certain delay from the opening of the former.

Also, while the afore-described embodiment employs the directional control valve 8 of a genuinely mechanical construction, it is alternatively possible to adopt a solenoid-operated valve for that purpose, with its electric contacts opened or closed by cam means to operate the valve.

FIG. 1(II) illustrates the opening characteristics of throttle and control valves in the intake system of a multicylinder engine embodying the invention. The characteristic diagram indicates that, when the throttle valve 3 has attained a prescribed opening a, the control valve $2_2$ first opens fully or almost fully in an instant, and the control valve $2_3$ likewise opens immediately upon the arrival of the throttle valve at a further opened position b.

Thus, the embodiment of the invention permits the control valves to open fully or almost fully, in succession, all in instantaneous motions. This ensures very good riding comfort for the driver, because of freedom from any shock of irregular combustion in the engine.

Second embodiment (Refer to FIGS. 4 through 9.)

The second embodiment of the invention is one in which, each time the throttle valve opens to a prescribed degree, each of the above-mentioned control valves opens instantly to a prescribed opening, independently of the throttle valve, and then continues to open as operatively connected to the throttle valve.

In this embodiment, some of intake manifold pipes $1_1$–$1_n$, namely, $1_2$–$1_n$, have normally closed control valves $2_2$–$2_n$ installed therein, one for each. Those valves instantly open to a prescribed degree, in succession, as the throttle valve 3 turns to prescribed openings, independently of the throttle valve, and then continue to open in coaction with the latter. The embodiment shown applies this technical ideal to a two-cylinder engine.

In the embodiment illustrated in FIGS. 4(I)–(III), only one of two intake manifold pipes $1_1$, $1_2$, namely $1_2$, has a control valve $2_2$. A throttle lever 25 is fixedly connected at its lower end to end of the gudgeon 24 of the throttle valve 3. This lever 25 is linked with the accelerator pedal (not shown) by a cable 26 connected to its upper part. Also, a link rod 27 is pivotally connected at one end to an intermediate point of the lever 25 and at the other end to a (first) link lever 29, which in turn has a hole at the opposite end of which the gudgeon 28 of the control valve $2_2$ fits loosely.

The throttle lever 25 has a bulged lower part forming a cam 30 and is normally biased counterclockwise by a tension spring 31 connected to its upper end.

To one end of the gudgeon 28 of the control valve $2_2$ is fixedly connected a control-valve actuating lever 32, which in turn is normally biased counterclockwise by a tension spring 33. Also, on the gudgeon 28 of the control valve $2_2$ is loosely fitted a second lever 34, which is connected to the rod 36 of a vacuum actuator 35. The actuator 35 includes a compression spring 38 situated inside its pressure chamber 37, and normally urges the rod 36 downward by virtue of the spring.

The reference numeral 39 indicates a directional control valves whose valve body 41 is normally urged upward by a compression spring 40 housed therein, so that the communication between its inlet port 42 and outlet port 43 is shut off but the outlet port 43 is communicated with the atmospheric air port 44. The valve 39 normally keeps the upper end of the valve body 41 in contact with the cam face 30 of the throttle lever 25, with the inlet port 42 communicated with the portion of the intake pipe between the control valve $2_2$ and the throttle valve 3 and the outlet port 43 communicated with the pressure chamber 37 of the vacuum actuator 35.

A vacuum stopper, designated 45, normally biases a stopper rod 48 to the right (as seen in FIG. 4(I)), by means of a compression spring 47 disposed in its pressure chamber 46, so that the tip of the rod 48 is in contact with one edge of the throttle lever 25, allowing the latter to keep the throttle valve 3 partly open for idling. The vacuum stopper 45 has its pressure chamber 46 in communication with the intake pipe $1_1$.

A vacuum switch 49 has a pressure chamber 50 containing a compression spring 51, by which a contact piece 52 is normally urged downward to provide a short connection between contacts 53*a*, 53*b*. The numeral 54 indicates a normally open solenoid-operated valve installed along a passageway 55 of a low speed fuel system, and 56 indicates a power source.

The operation of this embodiment is as follows. FIG. 4(I) shows the engine running with low load, or idling. During this operation the throttle lever 25 is in contact with the tip of the stopper rod 48 of the vacuum stopper 45 and, restricted by the rod, the throttle valve 3 is kept slightly open. At this point, the negative pressure or vacuum in the intake pipe $1_1$ is not strong enough to retract the stopper rod 48 of the vacuum stopper 45 against the force of the compression spring 47. Consequently, the throttle lever 25, restricted by the stopper rod 48, will not turn counterclockwise to bring the throttle valve to the fully closed position. As long as this situation holds, the cam 30 at the lower end of the throttle lever 25 engages at its groove with the valve body 41 of the valve 39, and the intake pipe $1_1$ and the pressure chamber 37 of the vacuum actuator 35 are kept out of communication. Without any vacuum to act in the pressure chamber 37 of the vacuum actuator 35, the second lever 34 remains inactive. The control valve $2_2$ too is kept fully closed with the actuating lever 32 under the urging of the tension spring 33. In this state, the vacuum switch 49 is also inoperative and the solenoid-operated valve 54 keeps the passageway 55 of the low-speed fuel system in the open position.

With the intake system of the engine in the state described above, the throttle valve 3 is slightly open and the control valve $2_2$ is fully closed. Consequently, the air admitted through the throttle valve 3 and fuel from the low-speed fuel passageway 55 is mixed to a proper mixing ratio, and the mixture is drawn into one of the two cylinders (not shown) via the intake pipe $1_1$ only.

Figure 4:
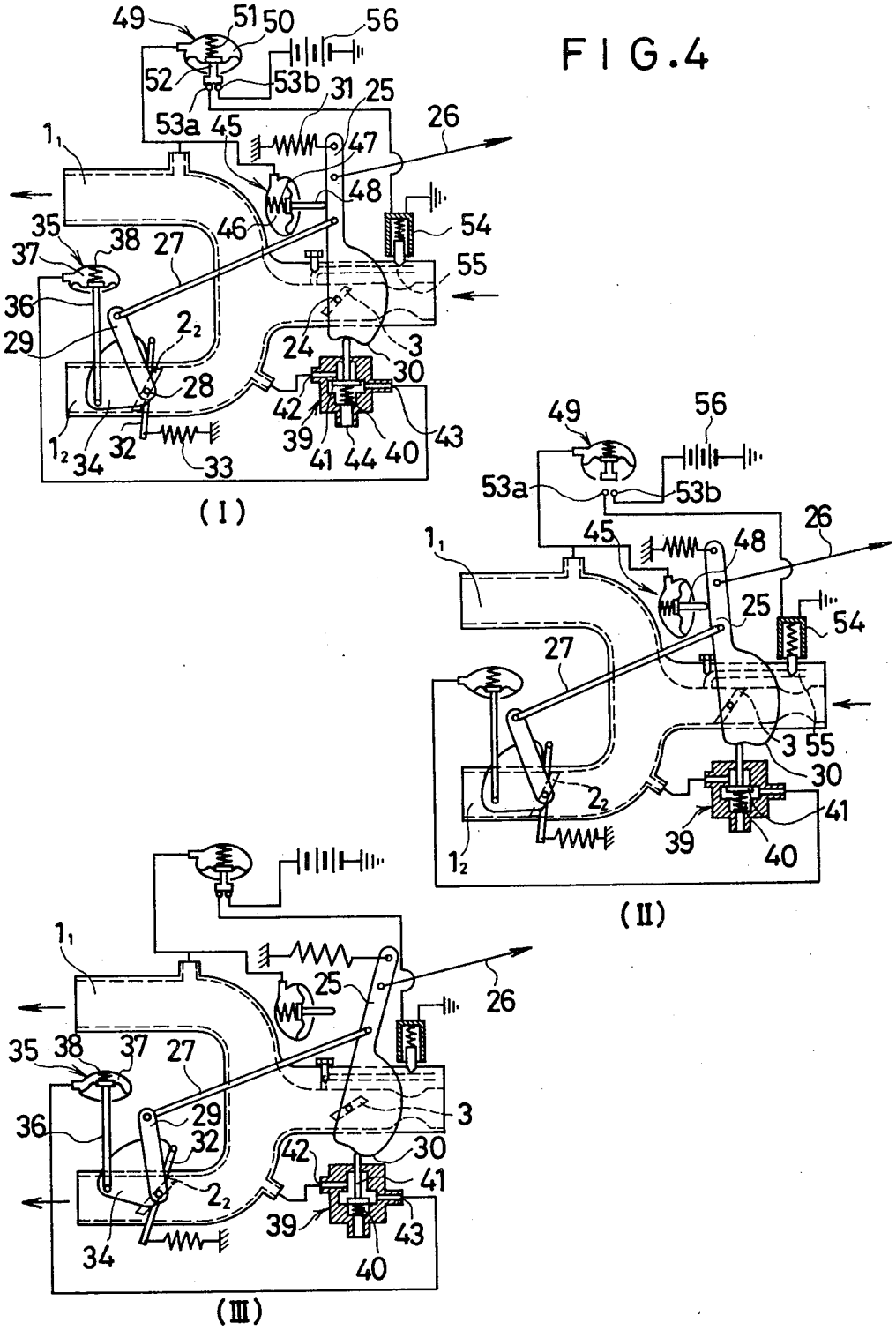
FIGS. 4(I) to (III) are fragmentary sectional views of an intake system for a multicylinder engine as the second embodiment of the invention in different stages of operation.

FIG. 4(II) shows the engine being reduced in speed. The vacuum in the intake pipe $1_1$ increases to such an extent that it actuates the vacuum stopper 45, causing it to move the stopper rod 48 to the left. Accordingly, the throttle lever 25 is turned counterclockwise, from the position shown in FIG. 4(I), until the throttle valve 3 is fully closed. The control valve $2_2$, on the other hand, remains totally closed as in FIG. 4(I), because the valve body 41 of the valve 39 is in contact with the groove of the cam face 30. In the same manner as the vacuum stopper 45, the vacuum switch 49 acts to disconnect the contacts 53*a*, 53*b*, with the consequence that the solenoid-operated valve 54 cuts off the passageway 55 of the low-speed fuel system.

Since the throttle valve 3 and the control valve $2_2$ are both fully closed in the engine intake system in the state described, the gaseous mixture of air and fuel from the low-speed fuel passageway is not drawn in by the engine (not shown).

FIG. 4(III) shows the same arrangements as above described shifting from the low-loading idling to medium- and high-load operations. As the accelerator pedal (not shown) is further depressed and the throttle lever 25 is turned clockwise by the cable 26 connected to the accelerator, the land of the cam 30 of the throttle lever 25 forces the valve body 41 of the directional control valve 39 downward against the force of the compression spring 40, thus establishing communication between the inlet port 42 and the outlet port 43 of the valve 39. The vacuum in the intake pipe $1_1$ now acts in the pressure chamber 37 of the actuator 35, enabling it to raise the rod 36 against the urging of the compression spring 38, and turn the second layer 34 clockwise. The clockwise turning brings the lever 34 into contact with the control-valve actuating lever 32 and causes the latter to turn clockwise, opening the control valve $2_2$ to a prescribed degree. As the throttle lever 25 is turned further clockwise, the (first) link lever 29 that coacts with the throttle lever 25 through the rod 27 comes into contact with the control-valve actuating lever 32, turning the control valve $2_2$ wide open.

With the intake system of the engine in the state just described, the throttle valve 3 and the control valve $2_2$ are both open and the intake pipe $1_2$ is now unchoked. The air-fuel mixture is drawn in by both the cylinders (not shown) through both the intake pipes $1_1$, $1_2$ of the intake manifold.

Figure 5:
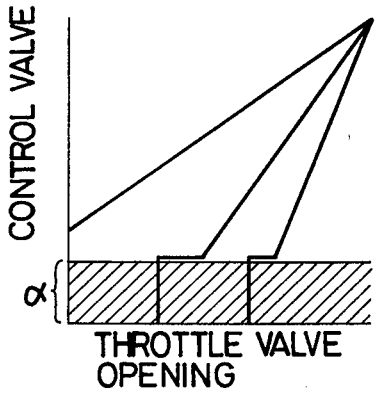
FIG. 5 is a graph showing the relation between control valve opening and throttle valve opening representing the characteristics of the second embodiment of multicylinder engine.

Although the operation of the embodiment illustrated in FIGS. 4(I) to (III) has been described above, it is to be understood that the basic technical concept of the invention does not reside in merely opening the control valve $2_2$ corresponding to the opening of the throttle valve 3 but in instantly opening the control valve to a prescribed degree, or to a degree at least beyond the irregular combustion zone $\alpha$ as indicated in FIG. 5, and thence further opening the valve specifically in relation to the opening of the throttle valve 3.

Figure 6:
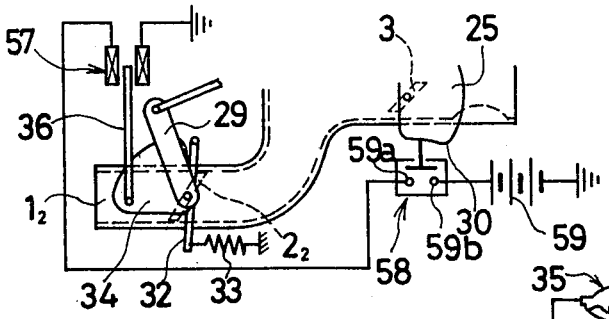
FIG. 6 is a fragmentary sectional view of a modification of the second embodiment which employs an electromagnetic actuator.

Arrangements in FIG. 6 are similar to those of FIGS. 4(I)–(III) but employ a solenoid-operated magnetic actuator 57 in place of the vacuum actuator 35 as means for opening the control valve $2_2$ and also use a limit switch 58 instead of the valve 39. The control valve $2_2$ is opened by connecting the contacts 59*a*, 59*b* with the cam face 30 of the throttle lever 25 and setting the magnetic actuator 57 in motion. The numeral 59 designates a power source.

Figure 7:
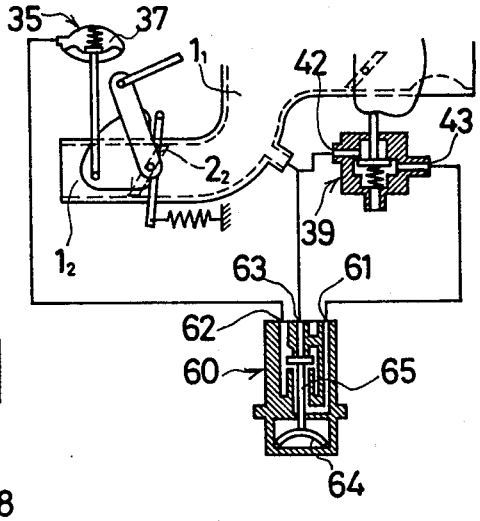
FIG. 7 is a fragmentary sectional view of another modification of the second embodiment including additional means to handle a cold engine.

FIG. 7 shows the intake system of FIGS. 4(I)-(III) plus corresponding means for operating a cold engine. This modification uses a three-port, temperature-sensing directional control valve 60 having an inlet port 61 communicated with the outlet port 43 of the directional control valve 39, an outlet port 62 communicated with the pressure chamber 37 of the vacuum actuator 35, and a bypass port 63 communicated with the inlet port 42 of the valve 39. Its valve body 65 is actuated by a temperature-sensing element 64 in such a manner that, while the engine is cold, it provides communication between the bypass port 63 and the outlet port 62.

With the intake system of the foregoing construction, the valve 39 is bypassed, while the engine is cold, so that the vacuum in the intake pipe $1_1$ acts in the pressure chamber 37 of the vacuum actuator 35 and causes the actuator to open the control valve $2_2$, thus facilitating the cold start of the engine.

Figure 8:
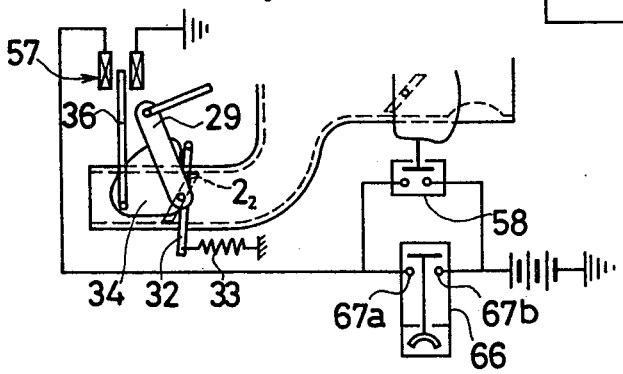
FIG. 8 is a view similar to FIG. 7 but showing another modification of the second embodiment.

FIG. 8 shows another modification which enables the modification of FIG. 6 to perform in the same way as the modification of FIG. 7. To realize the end, it uses a temperature-sensing switch 66 in parallel with the limit switch 58. When the engine is cold, the temperature-sensing switch 66 provides a short connection between contacts 67*a*, 67*b*, thereby allowing the magnetic actuator 57 to open the control valve $2_2$.

Figure 9:
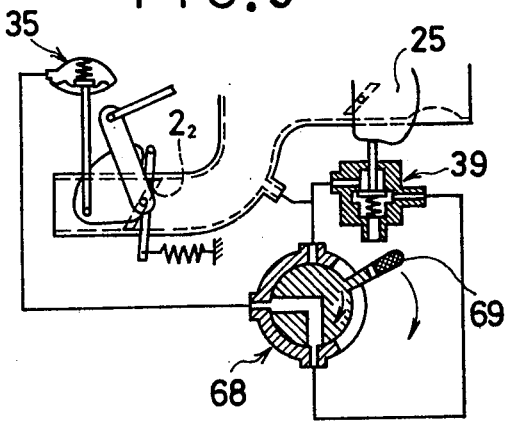
FIG. 9 is a similar view but showing still another modification of the second embodiment.

FIG. 9 reveals still another modification which replaces the three-port, temperature-sensing directional control valve 60 of FIG. 7 by a three-port directional control valve 68 to be manually operated. When the engine is cold, the control valve $2_2$ is operated by manipulation of a manual lever 69 associated with the valve 68. Excepting this, the arrangements and functions are the same as those illustrated in FIG. 7.

As has been described above, the intake system for a multicylinder engine embodying the invention is designed so that, as indicated in FIG. 5, the control valves instantly open to a prescribed degree, one after another. This eliminates uncomfortable shock of irregular combustion in the engine and ensures an extremely desirable ride for the driver. Moreover, the intake system for a multicylinder engine according to this invention, as embodied here, is capable of opening the control valves, when the engine is cold, even if the throttle valve is not open yet to a prescribed degree.

Figure 10:
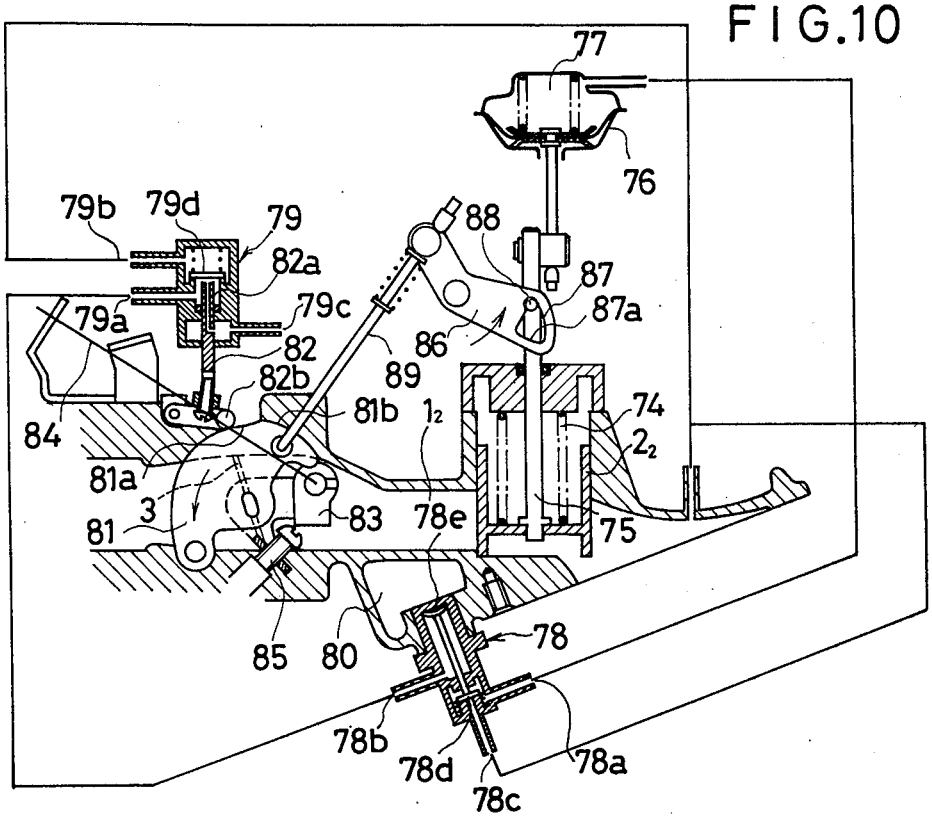
FIG. 10 is a vertical sectional view of arrangements for operating each control valve of the third embodiment of the invention.
Figure 11:
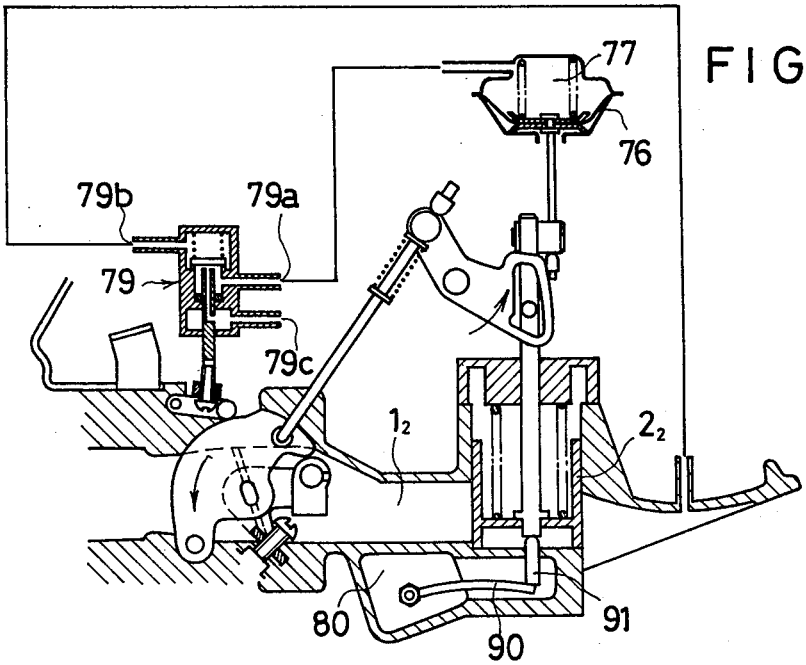
FIG. 11 is a vertical sectional view of modified arrangements for operating each control valve of the third embodiment.

Third embodiment (Refer to FIGS. 10 and 11.)

This embodiment is intended for improving the riding comfort for the driver during cold engine operation of a multicylinder engine. The arrangements enable a given one or two or all of control valves to be selectively opened while disregarding the running speed of the vehicle.

The third embodiment of the intake system for a multicylinder engine includes, as shown in FIG. 2, for example, normally closed control valves $2_2$, $2_3$ installed in certain ones $1_2$, $1_3$ of intake manifold pipes $1_1$–$1_3$ of the multicylinder engine and which can be opened, in succession, according to the car speed (i.e., the opening of the throttle valve). The third embodiment furnishes such an intake system for a multicylinder engine with auxiliary means for sensing the engine temperature and, when the temperature is below the prescribed level, allowing a selected one, two or all of the control valves to open regardless of the vehicular velocity.

FIG. 10 shows an actuating mechanism for the control valve $2_2$ installed in the intake pipe $1_2$. The control valve $2_2$ is normally biased toward the closing position by a spring 74 (FIG. 10 showing the valve normally closed) and is machanically linked with a vacuum actuator 76 by a rod 75. The vacuum actuator 76 has a pressure chamber 77 communicating with the outlet port 78*a* of a temperature-sensing directional control valve 78 and further with the outlet port 79*a* of a vacuum directional control valve 79 operable in accordance with the opening of the throttle valve, via the inlet port 78*b* of the valve 78, the inlet port 79*b* of the valve 79, in turn, communicating with a point of the intake pipe $1_2$ a certain distance downstream from the control valve $2_2$.

The temperature-sensing directional control valve 78 is provided wih a vacuum port 78*c* in addition to the outlet and inlet ports 78*a*, 78*b*. These ports 78*a*, 78*b*, 78*c* are controlled with the valve body 78*d*, in such a way that, when the engine temperature is below the prescribed level, the outlet port 78*a* communicates with a vacuum port 78*c*, and, as the temperature rises above the level, the outlet port 78*c* communicates with the inlet port 78*b*.

In the temperature-sensing directional control valve 78, the component designated 78*e* is a temperature sensor in the form of a bimetal disk fitted in the valve housing close to the surrounding wall of a cooling water passage 80 of the engine.

The vacuum directional control valve 79 has an atmospheric air port 79*c* in addition to the ports 79*a*, 79*b*. In normal condition the inlet port 79*b* is closed and the outlet port 79*a* communicates with the air port 79*c*. When the throttle valve 3 has opened to a prescribed degree, the vacuum directional control valve 79 is actuated so that the inlet port 79*b* and the outlet port 79*a* are communicated and the atmospheric air port is closed.

This embodiment includes a mechanism for actuating the vacuum directional control valve 79. The mechanism comprises a cam 81 adapted to rotate integrally with the throttle valve 3, and a rod 82 held in contact with the cam 81 to follow the cam motion and thereby move the valve body 79*d* of the directional control valve 79.

In FIG. 10, 82*a* is a passage or bore formed in the rod 82, 82*b* is a roller disposed at the foot of the rod 82, 81*a* is a groove formed on the surface of the cam 81, 81*b* is a land on the cam face, 83 is a throttle lever, 84 is a throttle cable, and 85 is a stopper for adjusting the opening of the throttle valve 3 for idling.

The embodiment further comprises a lever 86 pivoted to a suitable point of the housing. The lver is formed with a slot 87 at one end, which is slidably engaged with a protuberance or pin 88 provided on the rod 75 of the actuator 76. The other end of the lever 86 is linked with the cam 81 by a rod 89.

This embodiment is operated in the following way. If the accelerator pedal (not shown) is depressed when the engine temperature is above the prescribed level, that is, while the temperature-sensing directional control valve 78 is inoperative with the outlet and inlet ports 78*a*, 78*b* in communication, the throttle valve 3 is turned counterclockwise in the opening direction from the position in FIG. 10 by the throttle cable 84 and the throttle lever 83. Accordingly, the cam 81 too turns counterclockwise through a predetermined angle, where the roller 82*b* rides on the land 81*b* of the cam 81, thereby forcing the rod 82 upward. The upper end of the lifted rod 82 first comes into contact with the valve body 79*d* to close the passage 82*a*, and further raises the valve body 79*d* until communication is established between the inlet port 79*b* and the outlet port 79*a*. This permits the pressure chamber 77 of the actuator 76 to be communicated with the point of the intake pipe $1_2$ a certain distance downstream from the central valve $2_2$ via the outlet and inlet ports 78*a*, 78*b* of the temperature-sensing directional control valve 78 and the inlet and outlet ports 79*a*, 79*b* of the vacuum directional control valve 79, with the consequence that the actuator 76 is itself actuated by the manifold vacuum.

The actuator 76 operates to pull the valve body of the control valve $2_2$ upward by means of the rod 75. The control valve $2_2$ is now fully open or almost fully open. From then on, as long as the throttle valve 3 is at or above that degree of opening, the control valve $2_2$ will remain fully open or almost fully open.

With the rotation of the cam 81, the lever 86 is turned counterclockwise by the rod 89, with a consequent lift of the lower edge 87*a* of the slot 87. This is intended to prevent the closing of the control valve $2_2$ because of weakened actuating force of the vacuum actuator 76 due to the reduction in vacuum in the space of the intake pipe $1_2$ downstream from the control valve $2_2$ that results from the approach of the throttle valve 3 to the fully open position. To attain the end, the pin 88 on the rod 75 engages the lower edge 87*a* of the slot 87 to control the descent of the control valve $2_2$.

Conversely when the engine temperature is below the prescribed level (i.e., when the engine is cold) at the initial start, or when the temperature-sensing directional control valve 78 is in action with the outlet port 78*a* and the vacuum port 78*c* in communication, the pressure chamber 77 of the vacuum actuator 76 is communicated with the space in the intake pipe $1_2$ downstream from the control valve $2_2$ through the outlet port 78*a* and the vacuum port 78*c* of the temperature-sensing directional control valve 78 so that the actuator 76 operates on the manifold vacuum. In this state, therefore, the control valve $2_2$ is kept open independently of the opening of the throttle valve 3.

As described, this embodiment comprises a control valve actuating mechanism whereby the pressure chamber 77 of the actuator 76 that operates the control valve $2_2$ is communicated with the space in the intake pipe $1_2$ downstream from the control valve $2_2$ through the vacuum directional control valve 79 and the control valve is operated according to the opening of the throttle valve 3 in such a manner that the former can be opened according to the opening of the latter. Also, in addition to the actuating mechanism the temperature-sensing directional control valve 78 is disposed between the vacuum directional control valve 79 and the pressure chamber 77 of the actuator 76, so that, when the engine temperature is below the prescribed level, the vacuum directional control valve 79 is bypassed to conduct the vacuum in the space of the intake pipe $1_2$ downstream from the control valve $2_2$ to the pressure chamber 77 of the actuator 76 and thereby the control valve is opened in disregard to the opening of the throttle valve. In place of the above-mentioned temperature-sensing directional control valve 78, it is possible to use, as shown in FIG. 11, a temperature-sensing actuator 90, such as a bimetal element which deforms with the engine temperature, and utilize its force of deformation directly in opening the control valve $2_2$. In that case, the pressure chamber 77 of the actuator 76 may be communicated with the outlet port 79*a* of the vacuum directional control valve 79 and further, through the inlet port 79*b* of the same valve, with the space in the intake pipe $1_2$ downstream from the control valve $2_2$. In the modification shown in FIG. 11, the component 91 is a push rod for carrying the force of deformation from the temperature-sensing actuator 90 to the control valve $2_2$.

It is to be understood that the intake system for a multicylinder engine as embodied here is not limited to the particular embodiment and modification above described but may, of course, be variously embodied without departing from the spirit and scope of the invention. For example, it is possible to bias the control valve in the opening direction by a spring and close the valve by operating the vacuum actuator with the vacuum that develops between the throttle valve and the control valve in the intake pipe, and also locate the temperature-sensing directional control valve in the vacuum circuit from the intake pipe portion between the throttle valve and the control valve to the vacuum actuator, so that, when the engine temperature is below the prescribed value, the vacuum actuator is set open to the atmosphere by the temperature-sensing directional control valve to open the control valve.

The third embodiment of the intake system for a multicylinder engine, as described above, opens any or all of the control valves, when the engine is cold, independently of the opening of the throttle valve. Therefore, even during idling or for some time after the initial start, the cylinders usually used when the vehicle runs at medium to high speeds are fed with the air fuel mixture and improved riding comfort is obtained.

Figure 12:
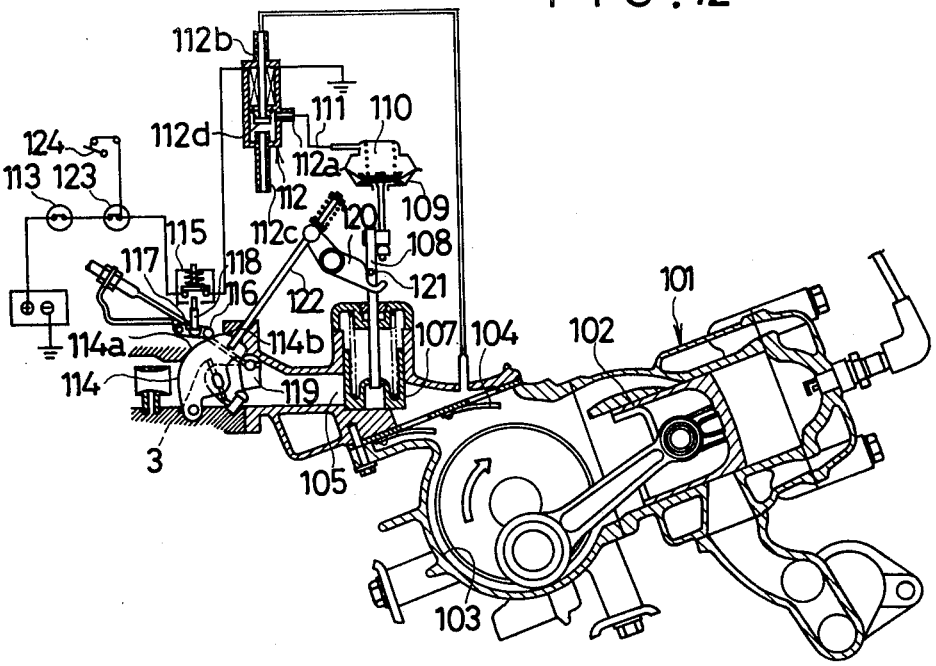
FIG. 12 is a vertical sectional view of the fourth embodiment of the invention.
Figure 13:
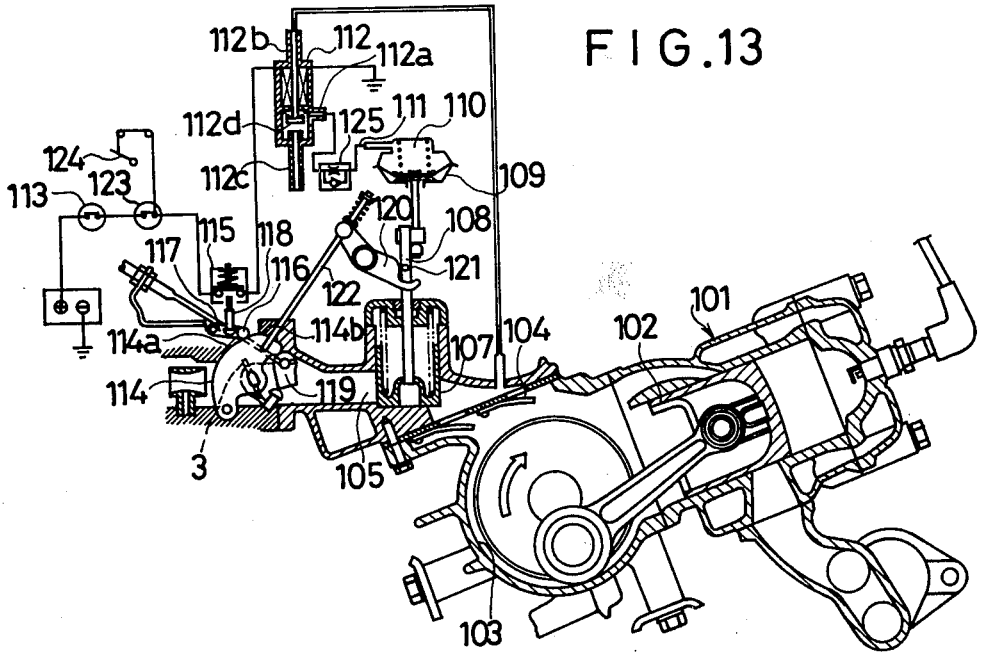
FIG. 13 is a vertical sectional view of a modification of the fourth embodiment.

Fourth embodiment (Refer to FIGS. 12 and 13.)

This embodiment is designed to improve the startability of an engine whose cylinders are controlled in number according to the operating requirements, the arrangements being such that when the clutch is disengaged the resulting signal causes a control valve or valves to operate momentarily.

The cylinder-number-controlled engine embodied here opens or closes control valves by virtue of vacuum. Only one cylinder equipped with a control valve is shown for simplicity.

Referring to FIG. 12, the numeral 101 indicates an engine cylinder, 102 a piston, 103 a crankcase, 104 a lead valve, 105 an intake pipe, and 3 a throttle valve. Inside the intake pipe 105 there is installed a control valve 107, which is mechanically linked with a vacuum actuator 109 by a rod 108. The vacuum actuator 109 has a pressure chamber 110 communicated with the outlet port 112*a* of a solenoid-operated directional control valve 112 through line 111. On the other hand, the inlet port 112*b* of the directional control valve 112 is communicated with the space in the intake pipe 105 downstream from the control valve 107. This valve 112 has an atmospheric air port 112*c* in addition to the ports 112*a*, 112*b*. When not energized, it keeps the air port 112*c* closed and the inlet and outlet ports 112*b*, 112 in communication. Upon energization, it closes the inlet port 112*b* and establishes communication between the outlet port 112*a* and the atmospheric air port 112*c*.

This solenoid-operated directional control valve 112 is energized, when a main switch 113 is turned on at the start of the engine, to close the control valve 107 as shown in FIG. 12. The directional control valve 112 so energized is then deenergized when a switch 115 is turned off by a cam 114 which turns together with the throttle valve 3.

In the same figure, 114*a* is a groove formed on the surface of the cam 114, 114*b* is a land of the cam, 116 is a roller held in contact with the cam face, 117 is a lever supporting the roller, 118 is an upright push rod for switch actuation connected at the lower end with the lever, and 119 is a throttle lever. In the valve 112, the valve body is indicated at 112*d*.

Further, in this embodiment, a lever 120 is pivoted to a suitable point of the housing. One end of the lever 120 is engaged with a pin 121 on the rod 108 of the actuator 109, and the other end is linked with the cam 114 by a rod 122.

According to this embodiment, a normally closed switch 123 is provided in series with the electric circuit of each solenoid-operated directional control valve of such a cylinder-number-controlled engine, the switch being turned off by the depression of the clutch pedal 124.

The operation of the embodiment will now be described below. For engine start the main switch 113 is turned on, and the solenoid-operated directional control valve 112 is energized to close the inlet port 112*b* and communicate the outlet port 112*a* with the atmospheric air port 112*c*. The pressure chamber 110 of the vacuum actuator 109, now open to the atmosphere, keeps the control valve 107 closed. In this case, the engine is idling as fuel is being supplied to the other intake pipe or pipes not shown.

In shifting the transmission from the neutral to the first speed position, the driver depresses the clutch pedal 124. This turns off the switch 123 operatively connected with the pedal 124. Thus, instantly the solenoid-operated directional control valve 112 is deenergized to close the air port 112*c* and communicate the outlet port 112*a* with the inlet port 112*b*. In this way the pressure chamber 110 of the vacuum actuator 109 is communicated with the space in the intake pipe 105 downstream from the control valve 107 and thereby the vacuum actuator 109 is actuated. The control valve 107 is consequently opened to supply fuel to the cylinder 101 shown.

This state is maintained until the depressed clutch pedal 124 is released following the shifting to the first gear position and the control valve 107 is reclosed. During this, the accelerator pedal (not shown) is depressed for added fuel supply to the cylinders 1. The depression of the accelerator pedal causes the throttle lever 119 to turn the throttle valve 3 counterclockwise, opening it wider. In this state, an increased amount of fuel corresponding to the opening of the throttle valve 3 is delivered to the other cylinders through the other intake pipes. With a further counterclockwise rotation of the throttle valve 3, the cam 114 turns in the same direction through a predetermined angle, where the roller 116 rides on the land 114*b* of the cam 114 and lifts the upright push rod 118 to disconnect the contacts of the switch 115. Consequently, the solenoid-operated directional control valve 112 is deenergized, with its atmospheric air port 112*c* closed and outlet and inlet ports 112*a*, 112*b* communicated. The pressure chamber 110 of the vacuum actuator 109 is thus communicated with the space in the intake pipe 105 downstream from the control valve 107, and the vacuum actuator 109 is operated. As the result, the control valve 107 is opened and the cylinder 101 shown, too, is supplied with fuel.

In the embodiment described above, the delay in response during the period from the shifting into the first gear position of the transmission to the release of the clutch pedal 124 and reclosing of the control valve 107 is taken advantage of in increasing the fuel supply by depression of the accelerator pedal (not shown) and opening of the throttle valve. Alternatively, the delay in response may be achieved by modified arrangement as shown in FIG. 13, in which a flow control valve 125 having a check valve function is disposed between the pressure chamber 110 of the vacuum actuator 109 and the outlet port 112*a* of the solenoid-operated directional control valve 112 to effect a positive delay in closing of the control valve 107. It should, of course, be clear to those skilled in the art that such a delay motion of the control valve 107 may be effected as well on the electric circuit of the solenoid-operated directional control valve 112.

As described above, the cylinder-number-controlled engine embodied here momentarily opens the control valves to operate more cylinders at the start of the vehicle and during acceleration with the transmission in the second speed position than during idling or running under low-load condition. The engine, therefore, delivers sufficient power when shifting gears, as well as at the vehicular start, to preclude engine stalling or other trouble due to inadequate power output.

What is claimed is:

1. In an engine having a plurality of cylinders, with a manifold pipe for an air fuel mixture flow to the cylinders and a plurality of intake pipe connected between the manifold pipe and each cylinder respectively, the improvement comprising;

a throttle valve movably mounted in the manifold pipe from a closed position to an open position;

a cam connected to said throttle valve and movable therewith;

a control valve movably mounted in at least one of the intake pipes from a closed position to an open position;

a control valve rod connected to said control rod and movable therewith;

actuator means connected to said control valve for instantaneously opening said control valve to a selected open position, said actuator means operatively connected to said throttle valve from its closed position, said selected open position being less than a fully open position of said control valve, said actuator means comprising a vacuum actuator having a pressure chamber bounded by a movable element which is connected to said control valve rod, and switching means connected to said vacuum actuator and operatively engaged with said throttle valve cam, for communicating said pressure chamber with one of the intake pipes to establish a partial vacuum in said pressure chamber and instantaneously open said control valve;

linkage means connected between said throttle valve and said control valve for causing movement of said control valve beyond said selected open position with movement of said throttle valve beyond a selected open position thereof, said means comprising a linkage rod connected to said cam, a pivotably mounted linkage lever connected to said linkage rod having a slot therein and pivotable with movement of said throttle valve, and a pin connected to said control valve rod and disposed in said slot for movement of said control valve only after movement of said throttle valve beyond said selected open position of said throttle valve; and throttle valve drive means connected to said position.

2. The improvement of claim 1, wherein said switching means comprises a three port valve having a first port connected to said pressure chamber, a second port connected to the atmosphere and a third port connected to said one of the input pipes, and an activation rod movable from a first position to maintain communication between said first and second ports and movable to establish a communication between said first and third ports, said throttle valve including a cam engageable with said activation rod for moving said activation rod with movement of said throttle valve by a selected amount.

3. The improvement of claim 2, including thermal activation means operatively connected with said vacuum actuator for operating said vacuum actuator to open said control valve below a selected temperature regardless of the position of said switching means.

4. The improvement of claim 3, wherein said thermal activation means comprises a second three port connected to the atmosphere, said pressure chamber and said one of the intake pipes.

5. The improvement of claim 3, wherein said thermal activation means comprises a bimetal strip engaged with said control valve for moving said control valve below a selected temperature.

6. The improvement of claim 1, wherein said switching means comprises a solenoid valve connected between said pressure chamber and said one of the intake pipes for communicating said pressure chamber to said one of the intake pipes upon deactivation of said solenoid valve to open said control valve, power supply means, a first contact switch connected between said power supply means and said solenoid openable to deactivate said solenoid upon engagement of a clutch for disengaging an outout of the engine, and a second contact switch connected in series with said first contact switch for deactivating said solenoid valve with movement of said throttle valve.

7. A multi cylinder engine whose working cylinders are variably controlled in number to suit operating requirements, with an air fuel mixture fed from a single throttle valve to the working cylinders through an intake manifold, comprising at least one normally closed control valve installed in at least one intake manifold downstream from said throttle valve through a directional valve, a cam connected to said throttle valve and engaged with said directional valve so that when said throttle valve has opened beyond a prescribed degree, said directional valve is operated with movement of said throttle valve to operate said vacuum actuator, said closed control valve being formed to open instantaneously to a prescribed degree thereof, independently of said throttle valve, and mechanical linkage means connected between said throttle valve cam and said control valve for mechanically opening said control valve with said throttle valve, with movement of said throttle valve beyond said described degree.

8. An engine according to claim 7, in which a three-port, temperature-sensing valve is disposed between said vacuum actuator and said directional valve so that, when the engine is cold, said directional valve is bypassed to establish communication between said vacuum actuator and said intake manifold so as to operate said vacuum actuator and open said control valve.

9. An engine according to claim 8, including a cylinder defined in said engine communicating with said intake manifold, said control valve slidably mounted in said cylinder and into said intake manifold, said mechanical linkage means comprises a rod connected to said piston, a pin connected to said rod, a pivotably mounted lever having an elongated slot therein, into which said pin is movable and a second rod connected between said lever and said throttle valve cam, said slot having a length to cause movement of said control valve with movement of said throttle valve only after said throttle valve has obtained said prescribed degree of opening thereof.

* * * * *